US011268507B2

(12) United States Patent
Chady et al.

(10) Patent No.: US 11,268,507 B2
(45) Date of Patent: Mar. 8, 2022

(54) FLUID END OF A HYDRAULIC FLUID PUMP AND METHOD OF ASSEMBLING THE SAME

(71) Applicant: GARDNER DENVER PETROLEUM PUMPS, LLC, Tulsa, OK (US)

(72) Inventors: Kyle Christopher Chady, Broken Arrow, OK (US); Paul Douglas Cary, Broken Arrow, OK (US); Ryan Huseman, Quincy, IL (US)

(73) Assignee: GARDNER DENVER PETROLEUM PUMPS, LLC, Tulsa, OK (US)

( * ) Notice: Subject to any disclaimer, the term of this patent is extended or adjusted under 35 U.S.C. 154(b) by 0 days.

(21) Appl. No.: 16/418,338

(22) Filed: May 21, 2019

(65) Prior Publication Data

US 2020/0370548 A1 Nov. 26, 2020

(51) Int. Cl.
*F04B 53/22* (2006.01)
*F04B 53/10* (2006.01)
*E21B 43/26* (2006.01)

(52) U.S. Cl.
CPC ..... *F04B 53/22* (2013.01); *F04B 53/10* (2013.01); *E21B 43/26* (2013.01)

(58) Field of Classification Search
CPC ..... F04B 15/02; F04B 53/007; F04B 53/10; F04B 53/16; F04B 53/22; E21B 43/26
USPC ..... 417/454
See application file for complete search history.

(56) References Cited

U.S. PATENT DOCUMENTS 3,435,870 A * 4/1969 Neuschotz ..... F16B 39/06 411/276
7,290,560 B2 11/2007 Orr et al.
7,341,435 B2 * 3/2008 Vicars ..... F04B 53/007 137/512
7,770,509 B2 * 8/2010 Kennedy ..... F04B 53/16 92/128
8,365,754 B2 * 2/2013 Riley ..... F04B 53/22 137/15.17
8,915,722 B1 * 12/2014 Blume ..... F04B 53/16 417/454
9,377,019 B1 * 6/2016 Blume ..... F04B 53/16
2008/0152523 A1 * 6/2008 Jensen ..... F04B 53/16 417/571

(Continued)

FOREIGN PATENT DOCUMENTS

WO 2020/112235 A1 6/2020

OTHER PUBLICATIONS

Forum Drilling Technologies, "High-Performance Valve Cover Retention System," <https://www.f-e-t.com/images/uploads/data-sheets/Valve_Cover_Retention_System.pdf> publicly available at least as early as Jun. 5, 2018 (2 pages).

(Continued)

*Primary Examiner* — Patrick Hamo

(74) *Attorney, Agent, or Firm* — Edell, Shapiro & Finnan, LLC

(57) ABSTRACT

A method of assembling a fluid end includes inserting a valve through a bore of a housing of the fluid end and into an interior volume of the fluid end, inserting a valve cover into the bore such that the valve cover seals the bore, and coupling a lock cover to the housing, the lock cover positioned over the bore to prevent removal of the valve cover from the bore. When the lock cover is coupled to the housing, the lock cover does not apply a preload against the valve cover.

20 Claims, 10 Drawing Sheets

(56) References Cited

U.S. PATENT DOCUMENTS

| | | | | |
|---|---|---|---|---|
| 2011/0283537 | A1 | 11/2011 | Case et al. | |
| 2017/0107983 | A1 | 4/2017 | Patterson et al. | |
| 2020/0182240 | A1* | 6/2020 | Nowell ..... | F16J 15/0887 |

OTHER PUBLICATIONS

Forum Drilling Technologies, "Pumps & Valves: P-Mac Valve Cover System," <https://www.f-e-t.com/images/uploads/data-sheets/PMAC.pdf> publicly available at least as early as Jun. 5, 2018 (2 pages).

Premium Oilfield Technologies, "Sur-Lock Valve Cover System," <https://www.premiumoilfield.com/index.php?option=com_content&view=article&id=53:sur-lock-valve-cover-system&catid=21:sur-lock-tabs1> publicly available at least as early as Jun. 5, 2018 (2 pages).

* cited by examiner

FLUID END OF A HYDRAULIC FLUID PUMP AND METHOD OF ASSEMBLING THE SAME

FIELD OF THE INVENTION

The present invention relates to a hydraulic fluid pump and, more particularly, to a fluid end assembly of a hydraulic fluid pump. Drilling pumps are used to provide high pressure fluid for drilling operations. The pumps typically include reciprocating plungers or pistons that provide the necessary high pressure fluid.

SUMMARY

In one embodiment, the invention provides a method of assembling a fluid end. A method includes inserting a valve through a bore of a housing of the fluid end and into an interior volume of the fluid end, inserting a valve cover into the bore such that the valve cover seals the bore, and coupling a lock cover to the housing, the lock cover positioned over the bore to prevent removal of the valve cover from the bore. When the lock cover is coupled to the housing, the lock cover does not apply a preload against the valve cover.

In another embodiment, the invention provides a method of assembling a fluid end of a pump assembly. The method includes securing a lock ring to the housing of the fluid end, the lock ring defining an axial bore centered about a central axis, axially inserting a lock cover into the axial bore, elastically deflecting a snap ring retainer against the lock ring, the snap ring retainer coupled to the lock cover, and aligning a post of the elastically deflected snap ring retainer with a post bore of the lock ring such that the post extends into the post bore.

In yet another embodiment, the invention provides a fluid end assembly of a hydraulic fluid pump. A fluid end assembly includes a housing having a bore, a valve cover positioned within the bore and configured to seal the bore, and a lock cover coupled to the housing and configured to retain the valve cover within the bore during operation of the fluid end. When the lock cover is coupled to the housing, the lock cover does not apply a preload against the valve cover.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
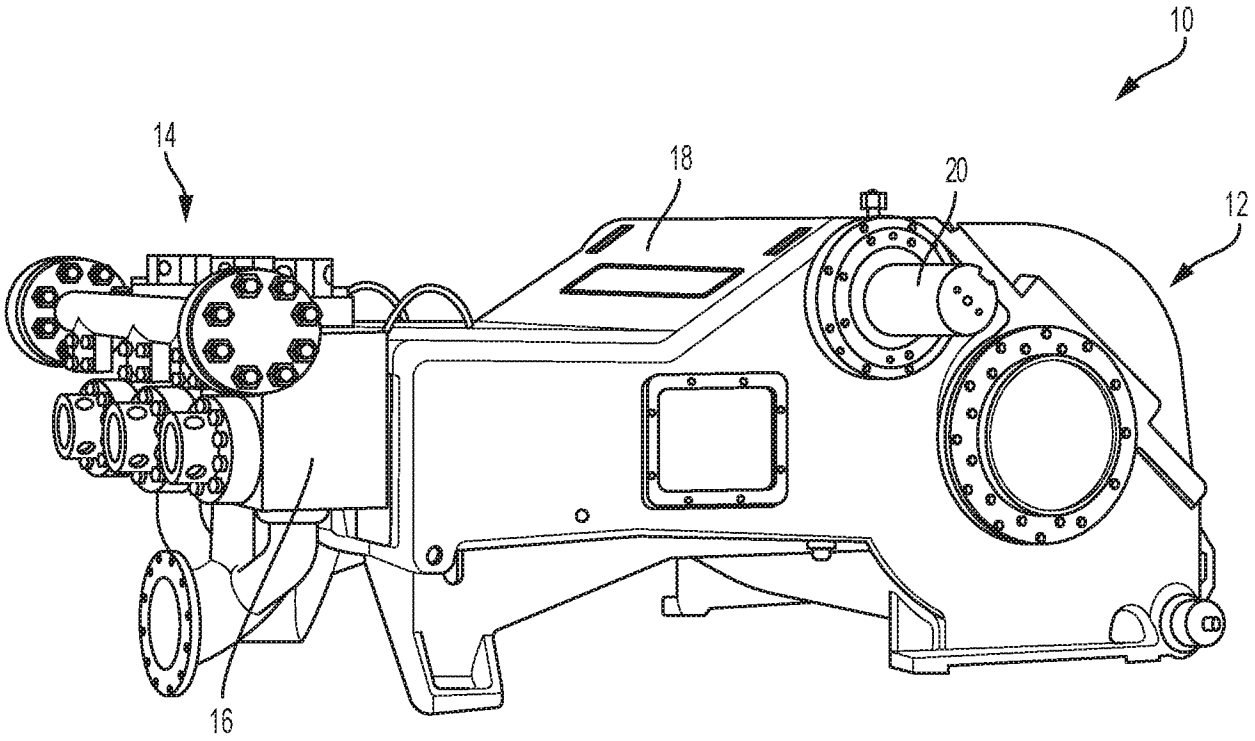
FIG. 1 is a perspective view of a hydraulic fluid pump.

FIG. 1 illustrates a hydraulic fluid pump 10 (e.g., a drill pump) of the type often used during drilling and hydraulic fracturing operations such as hydrocarbon or oil fracturing. The hydraulic fluid pump 10 includes a power end or drive end or drive end assembly 12 that is largely enclosed within a casing 18. A fluid end or fluid end assembly 14 attaches to the drive end 12 and the casing 18 and includes at least one fluid end block or drilling module 16, and as shown, includes three drilling modules 16. A drive shaft 20 extends out of the casing 18 and provides for a connection point for a prime mover such as a motor or engine. The prime mover drives the drive shaft 20 at a desired speed to power the drive end 12. The drive end 12 typically includes a transmission (e.g., gears, belts, chains, etc.) that serve to step down the speed of the drive shaft 20 to a speed appropriate for the fluid end 14. The drive end 12 includes a series of reciprocating mechanisms that in turn drives a piston or plunger within a respective bore of the fluid end block 16 to pump a fluid.

Figure 2:
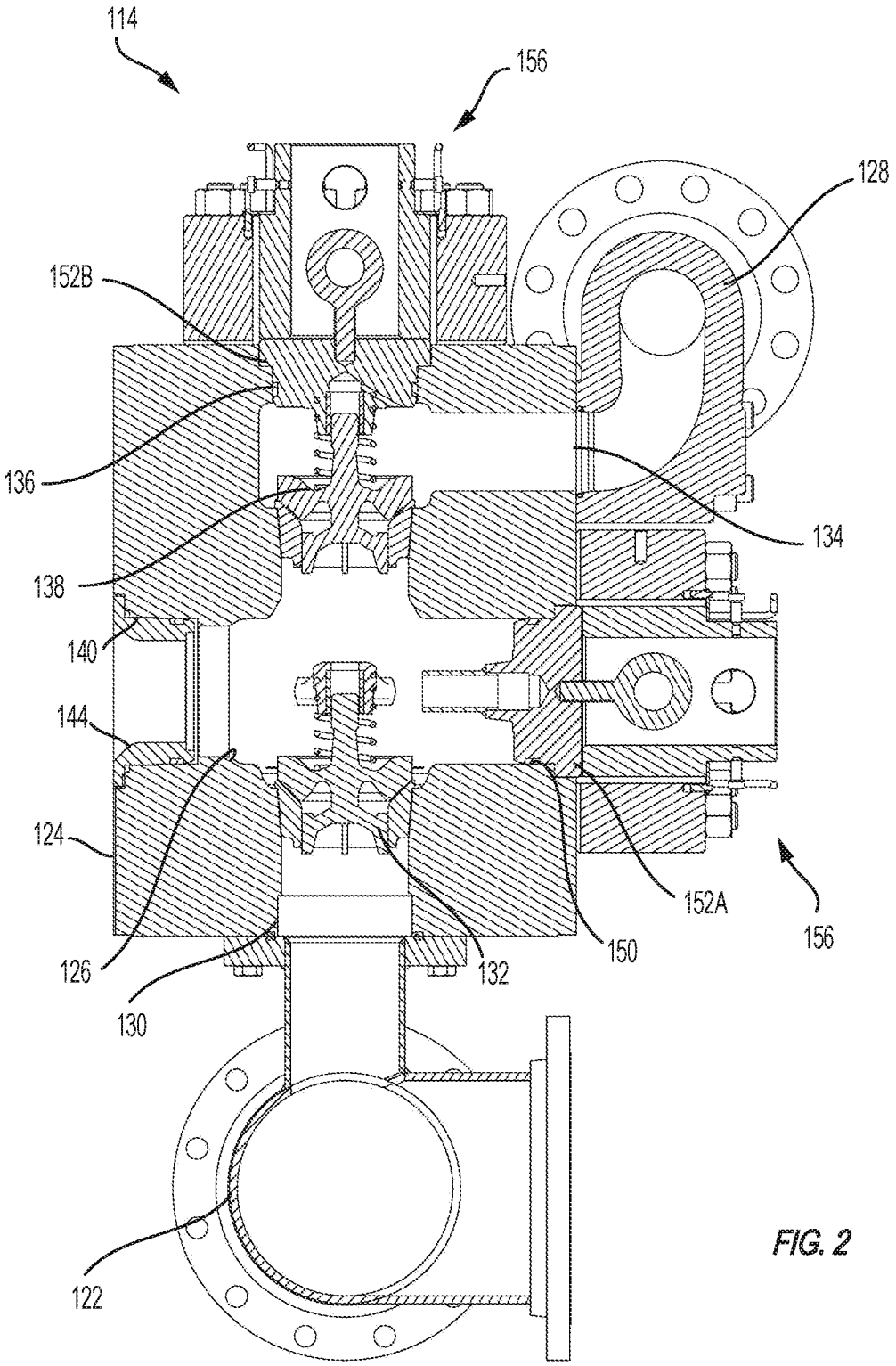
FIG. 2 is a cross-sectional view of a fluid end assembly of a hydraulic fluid pump.

A fluid end assembly 114 is illustrated in FIG. 2. A housing 124 defines the main body of the fluid end assembly 114 surrounding an interior volume 126. An inlet manifold 122 distributes fluid to an inlet bore 130 of each fluid end block 16. An inlet valve 132 is positioned in the inlet bore 130 to control flow from the inlet manifold 122 into the interior volume 126 of the fluid end 114, and more specifically, the interior volume 126 of the housing 124. An outlet bore 134 directs pressurized fluid from the interior volume 126, past an outlet valve 138, and to an outlet manifold 128 fastened to the fluid end 114 and aligned with the outlet 134 of the fluid end 114. The outlet manifold 128 is in fluid communication with the interior volume 126 of the housing 126 via the outlet bore 134 and outlet valve 138.

A service bore 136 is formed in the housing 124 adjacent the outlet valve 138 and in fluid communication with the outlet bore 134 at all operative times (i.e., not separated from the outlet bore 134 by the outlet valve 138). The service bore 136 is axially aligned with the inlet bore 130 and extends into the housing 124, intersecting the outlet bore 134. The service bore 136 provides access for insertion and removal of the outlet valve 138 from the housing 124 and is therefore sized to permit insertion and removal of the outlet valve 138.

A piston bore 140 extends perpendicular to the inlet bore 130 and supports a packing arrangement having a plurality of seals and a piston retainer 144. A reciprocating piston (not shown) is movable to pressurize fluid within the interior volume 126 and to the outlet manifold 128. A second service bore 150 is formed in the housing 124 parallel with and axially aligned with the piston bore 140 and provides access to the interior volume 126 of the housing 124 without removal of the piston, or the valves 132, 138. The second service bore 150 may additionally provide access for insertion and removal of the piston and/or the inlet valve 132 from the housing 124 and is sized accordingly.

Figure 3:
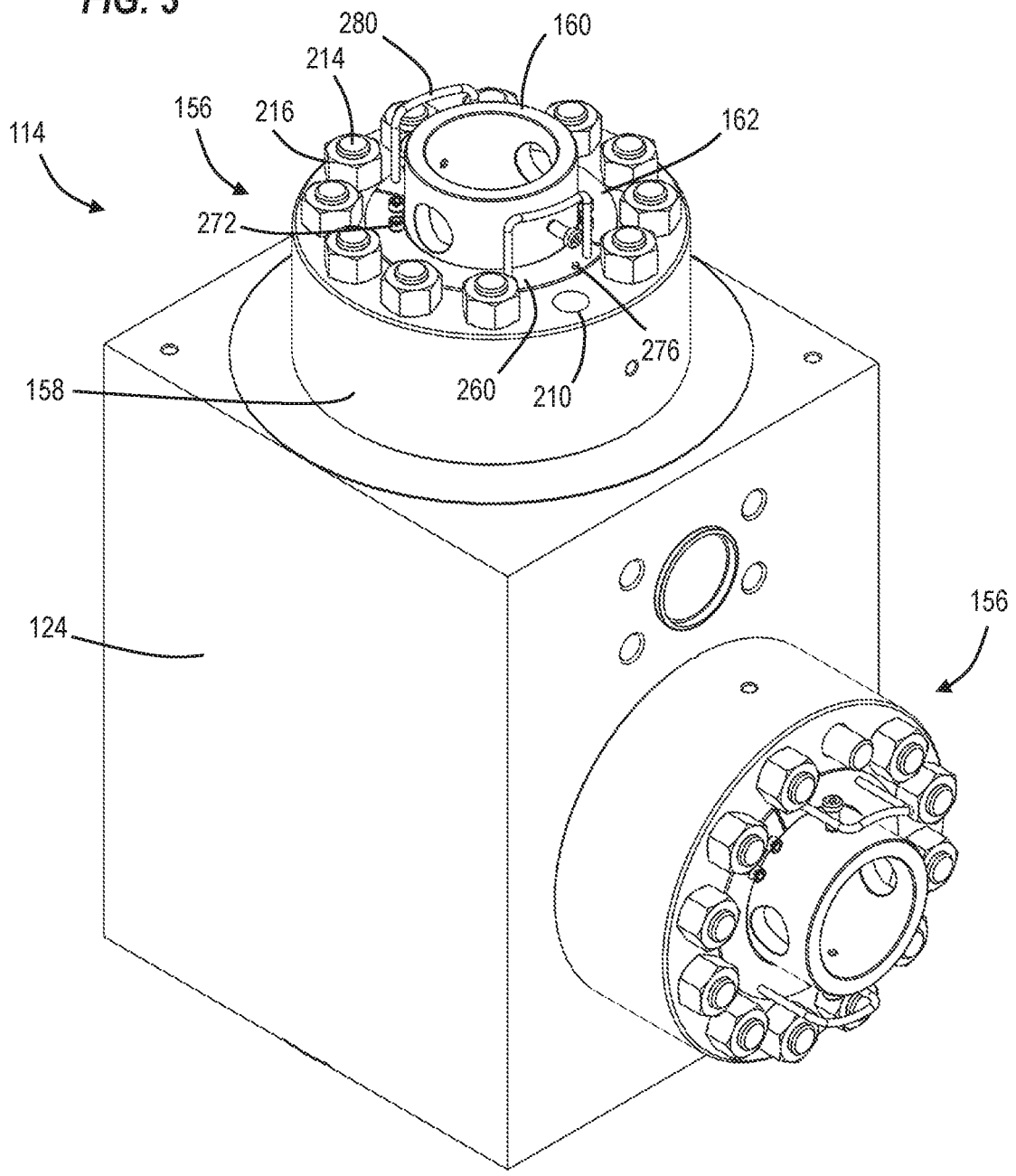
FIG. 3 is a perspective view of a valve retainer assembly with a fluid end assembly of a hydraulic fluid pump.

As shown, both of the service bores 136, 150 include valve covers 152A, 152B and retainer assemblies 156. The valve covers 152A, 152B seal against the housing 124 to prevent fluid from the interior volume 126 from passing through the respective bores 136, 150. Each retainer assembly 156 covers the respective valve cover 152A, 152B to retain the valve cover 152A, 152B in a sealing position within the respective bore 150, 136. When the reciprocating piston increases the pressure of the fluid within the interior volume 126 of the housing 124, a force is applied on the valve covers 152A, 152B. Each of the valve covers 152A, 152B is secured within the respective service bore 150, 136 via a respective valve retainer assembly 156. The description below refers to the valve retainer assembly 156 associated with the service bore 136 and the valve cover 152B. As shown in FIG. 3, the structure and assembly of the valve retainer assembly 156 associated with the service bore 150 and the valve cover 152A is similar.

In embodiments consistent with the prior art, a retainer applies a preload to the valve cover to counteract the force applied by the pressurized fluid and to prevent unseating of the valve cover seal (typically a face seal) from the housing. In contrast to the prior art, the valve retainer assembly 156 illustrated in FIG. 3 does not require a preload to counteract the force applied by the pressurized fluid and does not require a preload to prevent unseating of a valve cover seal 174 of the valve cover 152A, 152B from the housing 124. The valve cover seal 174 is described in greater detail below.

Figure 4:
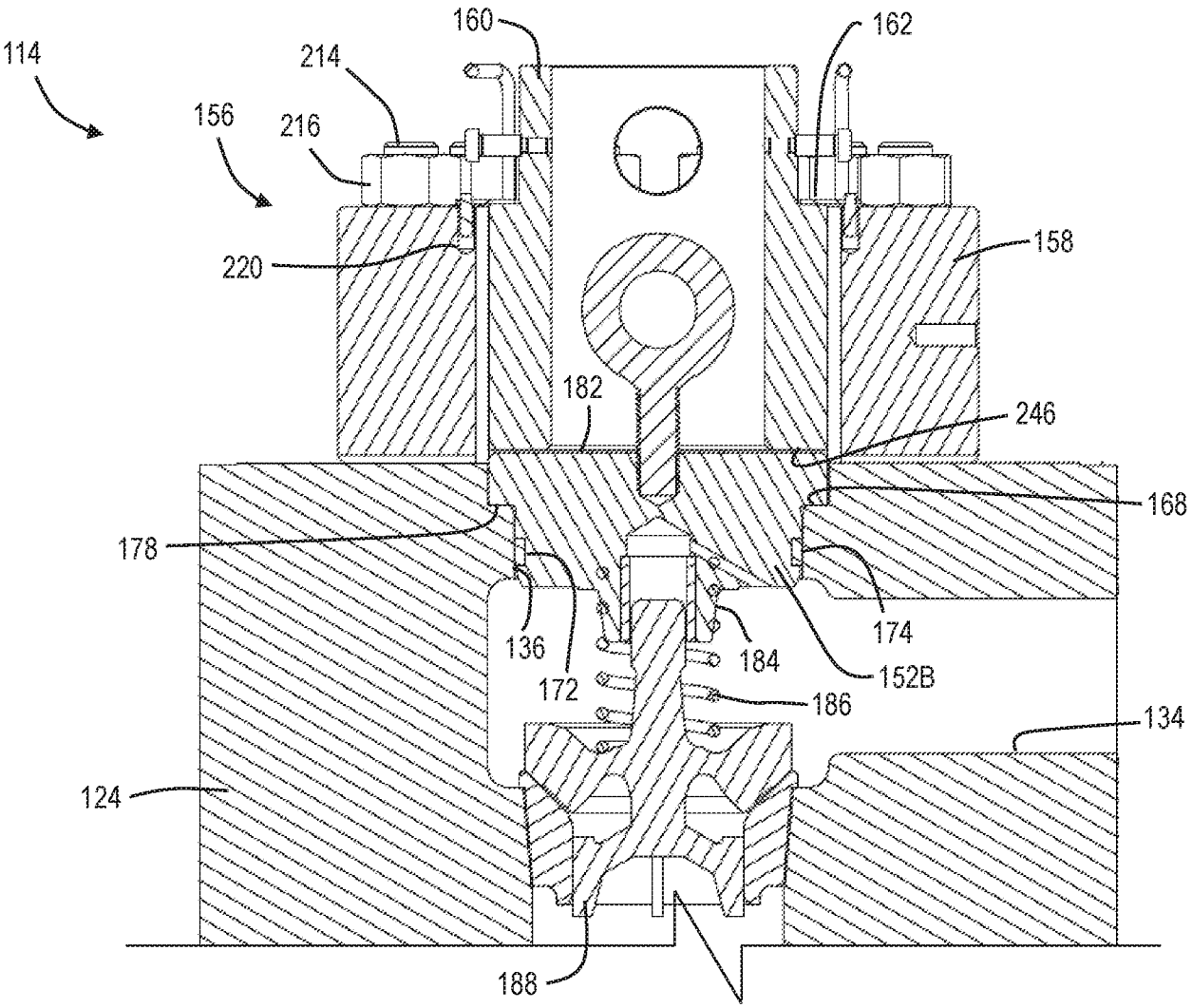
FIG. 4 is a sectional view of the valve retainer assembly of FIG. 3.

As shown in FIGS. 3-4, the service bore 136 of the housing 124 of the fluid end 114 is associated with the outlet valve 138 and provides access to the outlet valve 138 positioned within the housing 124. The outlet valve 138 is configured to control a flow of fluid within the housing 124. The bore 136 is sealed by a valve cover 152B, which is held in place via a valve retainer assembly 156. The valve retainer assembly 156 includes a lock ring 158, a lock cover 160, and a snap ring retainer 162. The valve retainer assembly 156 retains the valve cover 152B within the bore 136 of the housing 124 and counteracts the force applied on the valve cover 152B by pressurized fluid within the housing 124. However, the valve retainer assembly 156 does not apply a preload on the valve cover 152B.

Figure 5:
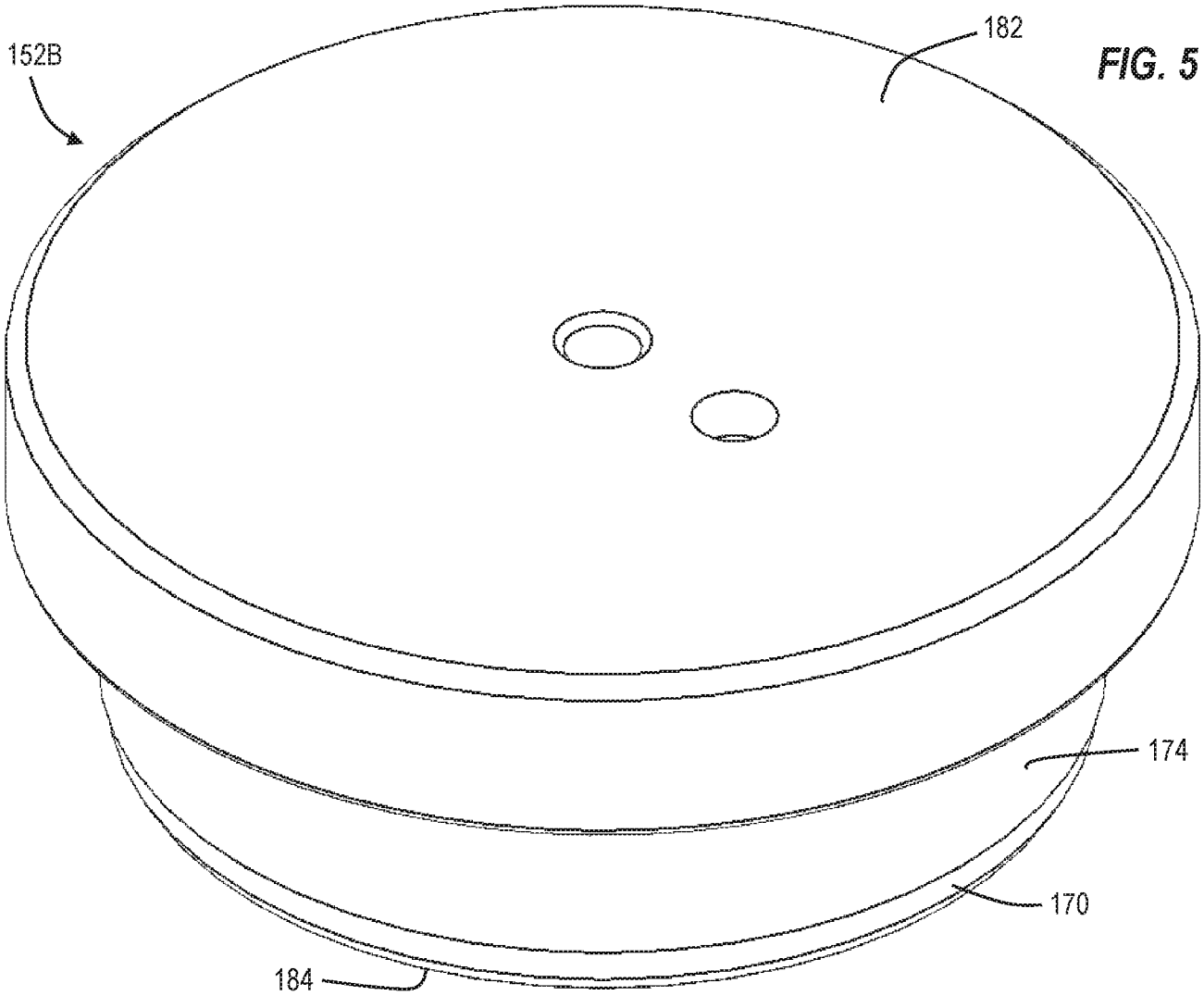
FIG. 5 is a perspective view of a valve cover for use with the valve retainer assembly of FIG. 3.

As shown in FIG. 5, the valve cover 152B is a cylindrical plug sized to engage the bore 136 of the housing 124. An outer periphery of the valve cover 152B is stepped so that the valve cover 152B rests against a lip 168 (FIG. 4) of the housing 124 in an axial (insertion) direction. The valve cover 152B includes a cylindrical peripheral surface 170 that defines a groove or cutout 172. A circumferential ring seal 174 (e.g., elastomeric seal) is positioned within the groove 172 of the valve cover 152B to seal the valve cover 152B relative to the housing bore 136. The seal 174 is positioned at an axial interface between the valve cover 152B and the housing 124. In other words, the seal 174 is positioned on the cylindrical outer surface 170 of the valve cover 152B and engages the cylindrical surface of the bore 136. Therefore, the seal 174 is energized by its placement within the housing bore 136 by its frictional engagement with the housing bore 136. In contrast, a seal that is located on the stepped face 178 (not the cylindrical surface 170, perpendicular to the cylindrical surface 170) of the valve cover 152B and engaging a face 168 of the housing that is, for example, perpendicular to the axial direction of the bore 136, is energized by preloading the valve cover 152B against the housing 124.

The valve cover 152B includes an upper surface 182 that engages the valve retainer assembly 156, as described in greater detail below. The valve cover 152B further includes a lower surface 184 that engages the outlet valve 138 (e.g., a spring 186 of the outlet valve 138) to retain and position the outlet valve 138 within the bore 136 of the housing 124. The spring 186 biases a valve member 188 of the outlet valve 138 in a closing direction. The lower surface 184 of the valve cover 152A associated with the service bore 150 does not engage any valve, but does provide access for removing and inserting the inlet bore 130.

Figure 6:
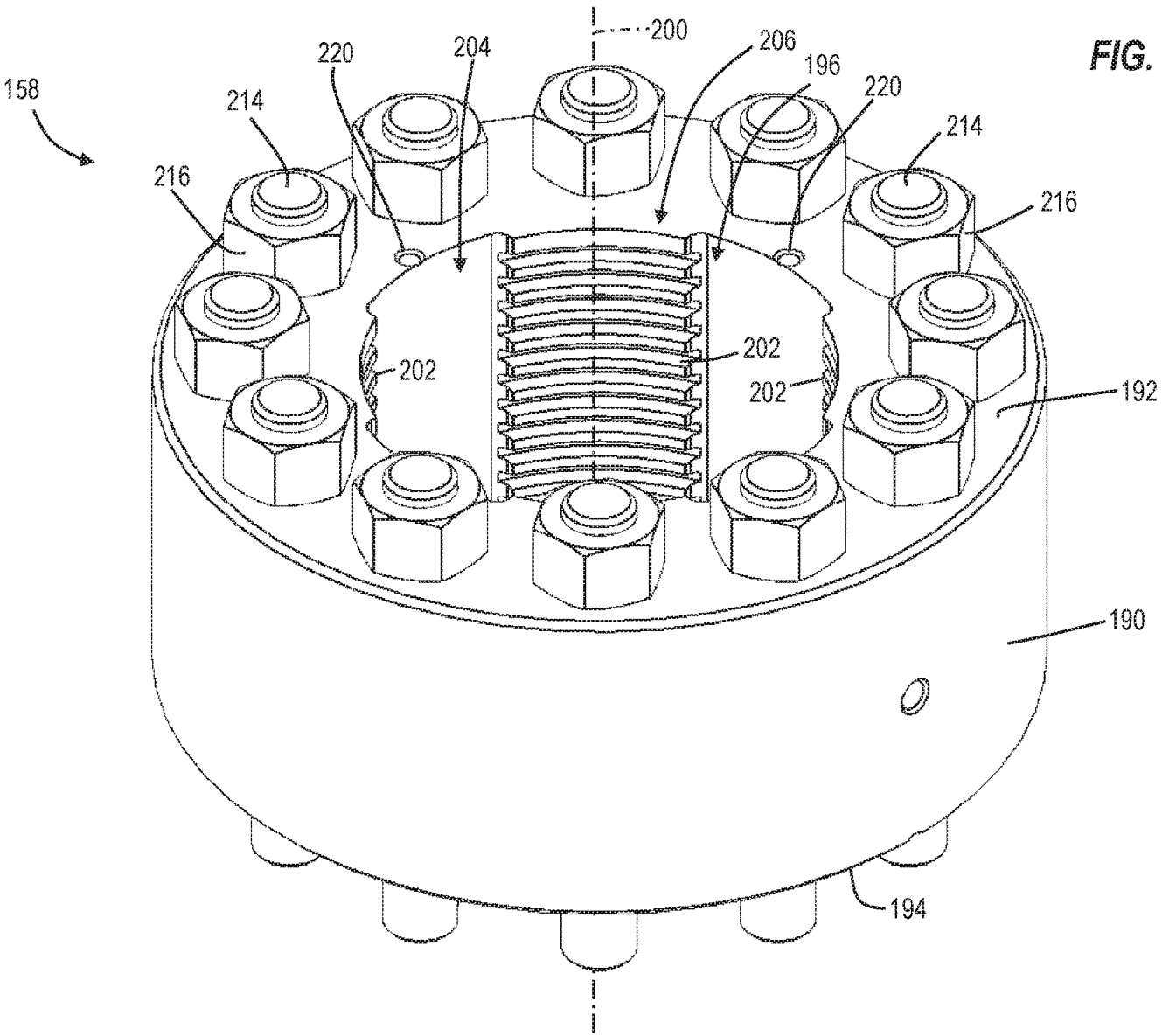
FIG. 6 is a perspective view of a lock ring of the valve retainer assembly of FIG. 3, the lock ring shown with associated fasteners.
Figure 7:
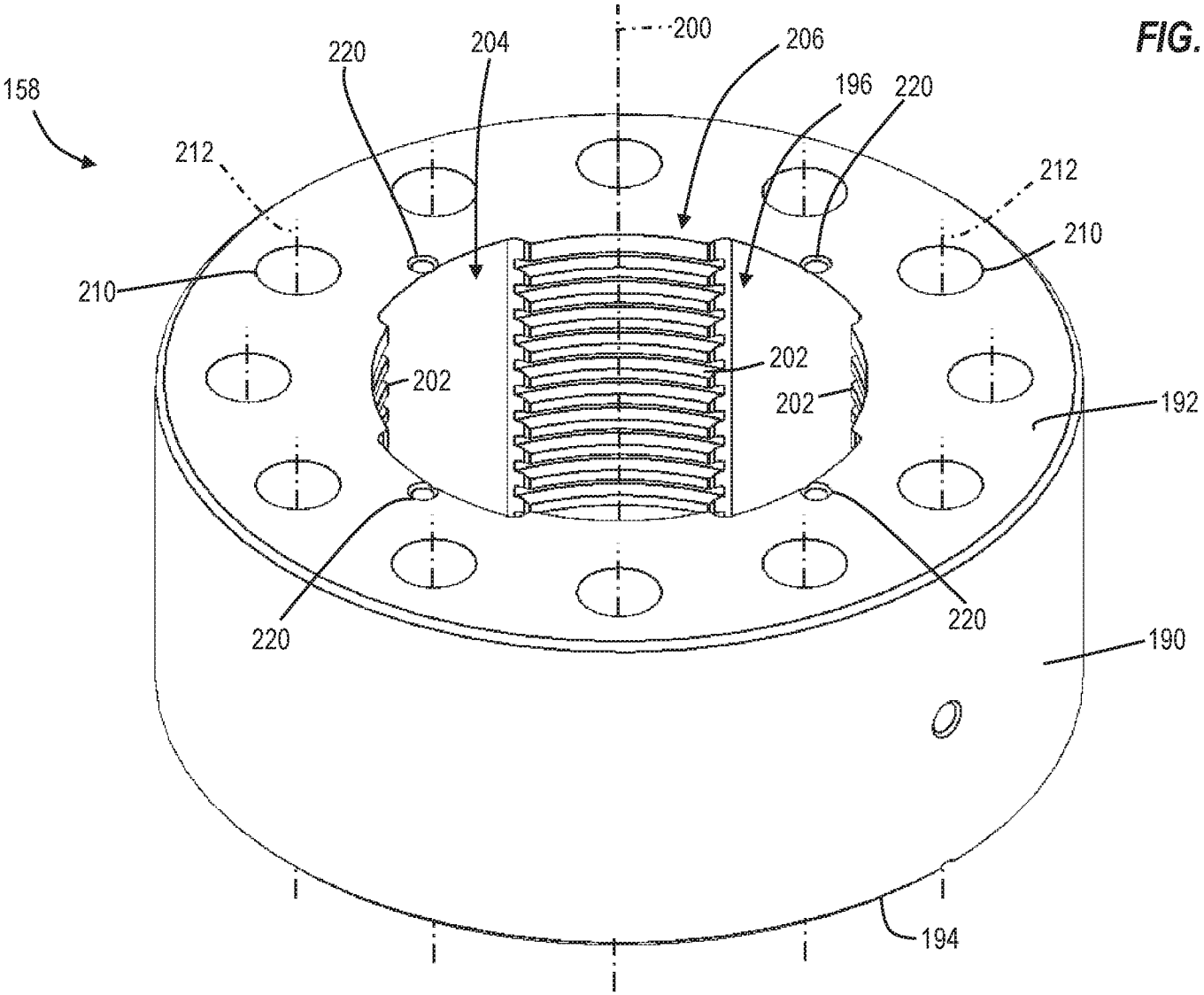
FIG. 7 is a perspective view of the lock ring of FIG. 6, shown without the associated fasteners.

As shown in FIGS. 6-7, the lock ring 158 of the valve retainer assembly 156 is a ring defined by a cylindrical outer surface 190 extending between a first axial end 192 and a second axial end 194, and a lock cover bore 196 extending through the lock ring 158 from the first axial end 192, through the second axial end 194. The lock cover bore 196 is therefore a through-bore extending entirely through the axial length of the lock ring 158. As shown, the lock cover bore 196 is centered on the lock ring 158 such that a central axis 200 of the lock cover bore is collinear with a central axis of the cylindrical outer surface 190 of the lock ring 158. In other embodiments, the lock ring 158 may be non-cylindrical or may be formed as a plate that is associated with a plurality of valve covers 152B along a length of the fluid end 114.

The lock cover bore 196 is a threaded bore, and more specifically includes a plurality of broken, zero-pitch threads or lugs 202. As shown, the lock cover bore 196 includes twelve threads 202 spaced apart along the length of the bore between the first and second axial ends 192, 194 of the lock ring 158. In other embodiments, the lock cover bore 196 may include more or less threads 202 (e.g., at least one, at least two, etc.). The threads 202 have no pitch and are therefore not interconnected with one another as a spiral. Rather each thread 202 is flat or planar and is defined within a plane that is perpendicular to the central axis 200 of the lock cover bore 196 and parallel with the respective plane of each additional thread 202. In other embodiments, the threads 202 of the lock cover bore 196 may have a pitch along the axial length of the lock ring 158.

Each of the plurality of threads 202 is broken or interrupted such that each thread 202 is non-continuous, but instead defines a gap 204 at intervals along the thread 202. As shown, each thread 202 of the plurality of threads is broken into four broken thread segments 206 of 45 degrees, with a gap 204 in between each segment of 45 degrees. In other embodiments, each thread 202 may be broken into more or less segments 206 (e.g., two broken thread segments 206 of 90 degrees separated by 90 degree gaps 204, three broken thread segments 206 of 60 degrees separated by 60 degree gaps 204, etc.). Further, in some embodiments, the sizes of the gaps 204 may be dissimilar to the sizes of the broken thread segments 206. Each thread 202 of the respective broken thread segment 206 is axially aligned with every other thread of the respective broken thread segment 206 such that the gaps 204 are axially aligned. Therefore, each axial gap 204 extends through the entire lock cover bore 196 between the adjacent broken thread segments 206.

The lock ring 158 further includes a plurality of fastener bores 210 (FIG. 7) positioned around the lock cover bore 196. As shown, twelve fastener bores 210 are positioned radially outward from the lock cover bore 196, extending axially through the lock ring 158 from the first axial end 192 to the second axial end 194. Central axes 212 of the fastener bores 210 extend parallel to one another and parallel to the central axis 200 of the lock cover bore 196. The fastener bores 210 are spaced equidistant from one another (as shown, spaced apart 30 degrees from the next adjacent bore 210) about the lock cover bore 196.

As shown in FIG. 6, fasteners 214 (e.g., threaded fasteners such as bolts, threaded studs, etc.) extend through the fastener bores 210. The fasteners 214 are longer than the fastener bores 210 (i.e., longer than the axial length of the lock ring 158) such that when the second axial end 194 of the lock ring 158 is positioned on the housing 124 of the fluid end 114, the fasteners 214 extend through the fastener bores 210 of the lock ring 158 and into respective threaded fastener bores (not shown) of the fluid end housing 124. As shown, the fastener 214 is a threaded stud. Each fastener 214 further includes a nut 216 that is threaded onto the threaded stud 214 and into engagement with the first axial end 192 of the lock ring 158. The fasteners 214 couple the lock ring 158 to the housing 124 of the fluid end 114.

The lock ring 158 further includes a plurality of post bores or snap ring retainer bores 220, which extend axially from the first axial end 192 of the lock ring 158 toward the second axial end 194. The snap ring retainer bores 220 are located radially between the lock cover bore 196 and the cylindrical outer surface 190 of the lock ring 158 and extend in an axial direction, parallel to the central axis 200 of the lock cover bore 196. As shown, the snap ring retainer bores 220 are located nearer the lock cover bore 196 than to the cylindrical outer surface 190 of the lock ring 158. The snap ring retainer bores 220 are blind holes or blind bores that are formed in the first axial end 192 and end prior to the second axial end 194. As shown, the snap ring retainer bores 220 are unthreaded. There are four snap ring retainer bores 220, each offset from one another by ninety degrees. In some embodiments, the number of snap ring retainer bores 220 may correspond to the number of broken thread segments 206 (as shown, four broken thread segments 206) of the lock cover bore 196. The snap ring retainer bores 220 will be described in greater detail below with respect to the snap ring retainer 162.

Figure 8:
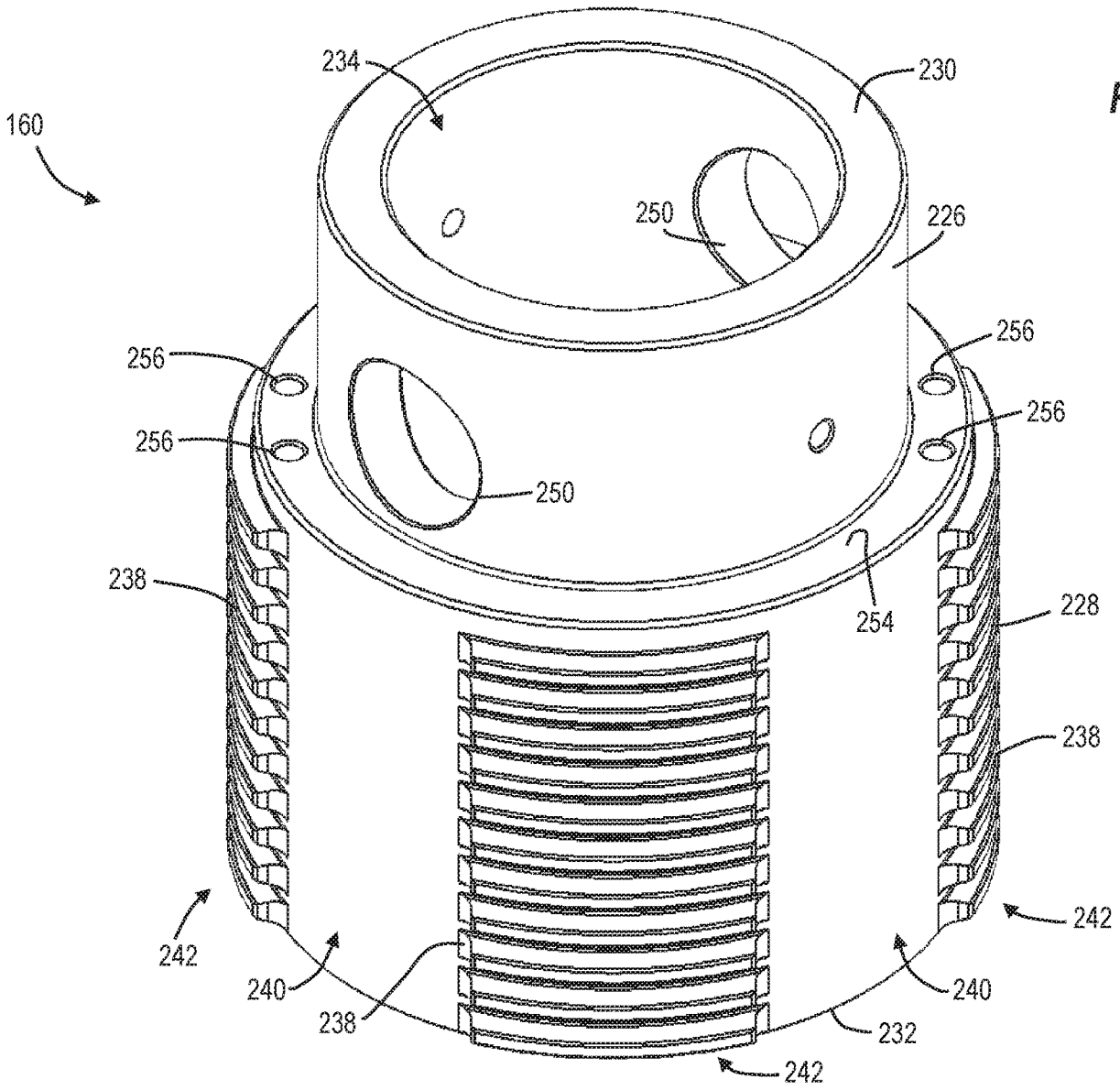
FIG. 8 is a perspective view of a lock cover of the valve retainer assembly of FIG. 3.

As shown in FIG. 8, the valve retainer assembly 156 includes a lock cover 160. The lock cover 160 is configured to be inserted into the lock cover bore 196 of the lock ring 158 and is generally cylindrical, having an upper portion 226 extending from a first axial end 230 and a lower portion 228 extending from the upper portion 226 to a second axial end 232. The lock cover 160 further includes a central bore 234 extending from the first axial end 230 to the second axial end 232.

The lower portion 228 is a threaded portion and includes external threads 238, similar to the internal threads 202 of the lock cover bore 196. The external threads 238 are broken zero pitch threads sized to engage the threads 202 of the lock cover bore 196. As shown, the lock cover 160 includes eleven threads 238 to engage within the twelve threads 202 of the lock cover bore 196. The threads 238 are broken such that the broken thread segments 242 (separated from one another by gaps 240) of the external threads 238 fit within the gaps 204 between the broken thread segments 206 in the lock cover bore 196 (i.e., are equal to or less than the size of the gaps 204 in the lock cover bore 196) and the arrangement of the broken thread segments 242 allow them to each be aligned with and placed within respective gaps 204 in the lock cover bore 196. As the threads 238 are broken, the threads 238 of the lock cover 160 are engaged with the lock cover bore 196 by first axially inserting the lock cover 160 into the lock cover bore 196 with the broken thread segments 242 of the lock cover 160 positioned in the gaps 204 defined between the broken thread segments 206 of the lock cover bore 196. Then, once the lock cover 160 is axially positioned, the lock cover 160 is rotated relative to the lock cover bore 196 so that the threads 202, 238 engage one another. As shown, this includes rotating the lock cover 160 by 45 degrees. In some embodiments, one pair of mating threads 202, 238 (e.g., the lowest thread) of the lock cover 160 and the lock cover bore 196 may be larger and/or spaced apart at a greater distance from one another than the remainder of threads 202, 238 so that the lock cover 160 is only capable of engaging the lock cover bore 196 at one axial position along the axial length of the lock cover bore 196.

The second axial end 232 of the lock cover 160 defines an abutment surface 246 (FIG. 4) for contacting the top surface 182 of the valve cover 152B when the lock cover 160 is installed within the lock cover bore 196 of the lock ring 158. As shown, the abutment surface 246 directly contacts the valve cover 152B, and specifically, as shown in FIG. 4, contacts the radial periphery of the top surface 182 of the valve cover 152B. In other embodiments, the abutment surface 246 may indirectly contact the valve cover 152B via an intermediate component.

The upper portion 226 of the lock cover 160 is cylindrical and extends upward from the lower portion 228 to the first axial end 230 of the lock cover 160. The upper portion 226 includes various assembly features, such as radial apertures 250 (extending transverse to the central bore 234 of the lock cover 160) that assist in the installation of the lock cover 160 within the lock ring 158.

The lock cover 160 is stepped between the upper and lower portions 226, 228 of the lock cover 160 (i.e., above the threaded portion), defining a stepped ring-shaped surface 254 perpendicular to the central bore 234 of the lock cover 160. The ring-shaped surface 254 includes a plurality of fastener bores 256 (e.g., threaded bores) for coupling the snap ring retainer 162 to the lock cover 160. As shown, there are two pairs of fastener bores 162 located on opposite sides of the central bore 234 of the lock ring 160.

Figure 9:
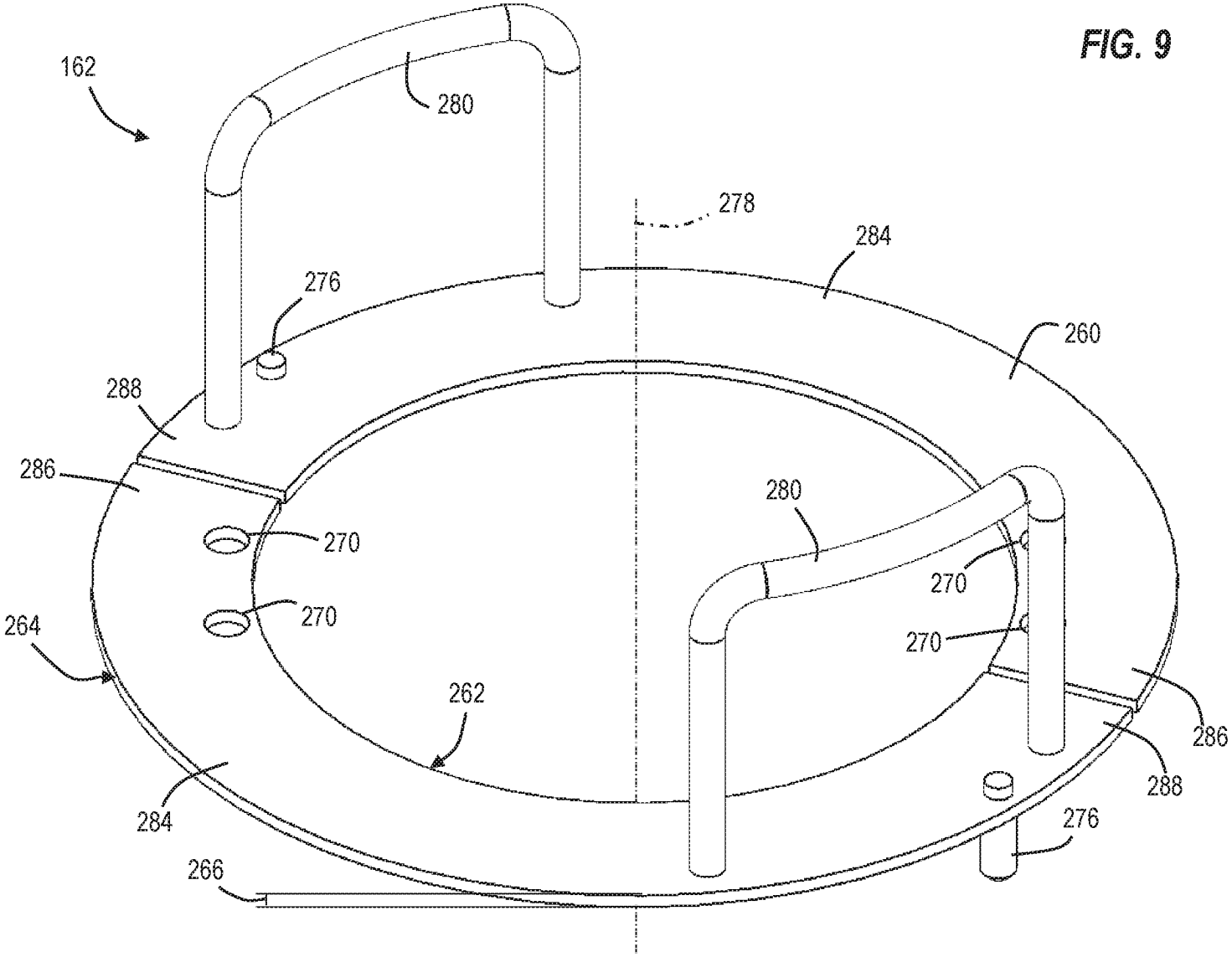
FIG. 9 is a perspective view of a snap ring retainer of the valve retainer assembly of FIG. 3.

As shown in FIG. 9, the valve retainer assembly 156 includes a snap ring retainer 162. The snap ring retainer 162 includes a body or ring 260 of elastically resilient material capable of bending and returning to its original form. As shown, the ring 260 is a thin metal (e.g., steel, spring steel, etc.) ring having a width defined between an inner bore diameter 262 (e.g., 5-8 inches) and an outer diameter 264 (e.g., 8-12 inches) and a thickness 266 (e.g., 0.125 inches, 0.0625 inches) that permits elastic flexing of the ring 260. The ring 260 is sized to overlap the ring-shaped surface 254 of the lock cover 160 and the first axial end 192 of the lock ring 158 when assembled.

Figure 10:
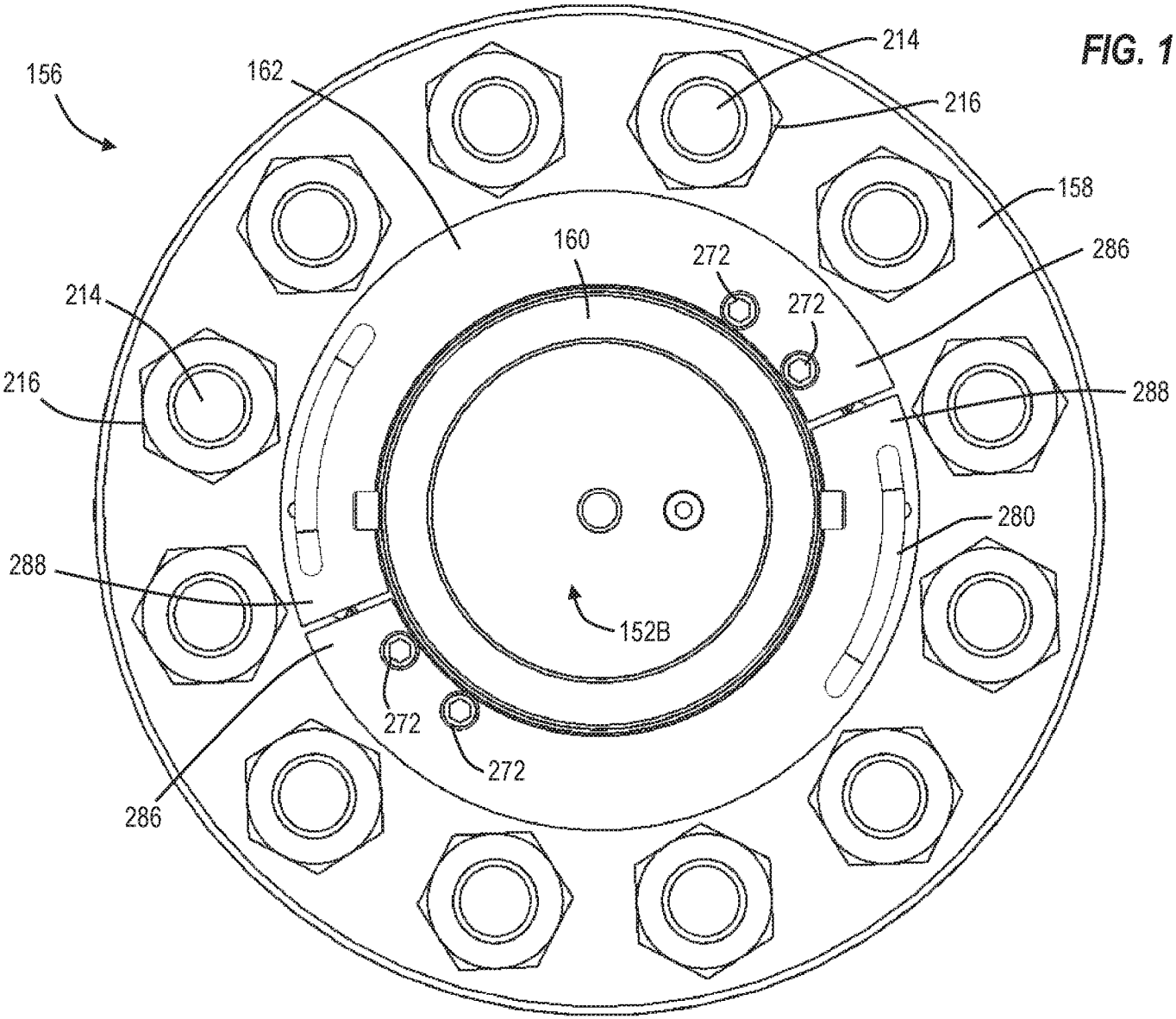
FIG. 10 is a top view of the valve retainer assembly of FIG. 3.

The ring 260 includes fastener bores 270 that extend through the thickness 266 of the ring 260 and are sized and spaced apart similar to the fastener bores 256 on the ring-shaped surface 254 of the lock cover 160. The fastener bores 270 are located nearer the inner bore diameter 262 of the ring 260 than the outer diameter 264 of the ring 260. As shown in FIGS. 3 and 10, fasteners 272 (e.g., bolts, studs fastened with nuts) extend through the fastener bores 270 of the snap ring retainer 162 and into the fastener bores 256 of the ring-shaped surface 254 of the lock cover 160 to fasten the snap ring retainer 162 to the lock cover 160.

With continued reference to FIG. 9, the snap ring retainer 162 further includes a plurality of posts 276 (as shown, two posts) that extend axially (in the direction of the thickness 266 of the ring 260) from the ring 260. The posts 276 are assembled (e.g., pressed into engagement with, adhered, fastened, etc.) to the ring 260. When assembled to the lock cover 160, the posts 276 extend downward from the ring 260 toward the lower (threaded) portion 228 of the lock cover 160, and toward the lock ring 158. The posts 276 are positioned radially further outward than the fastener bores 270 and are positioned nearer the outer diameter 264 of the ring 260 than the inner bore diameter 262 of the ring 260.

The posts 276 are further offset from the fastener bores 270 (e.g., offset by 90 degrees along the diameter 264 of the ring 260) such that each post 276 is separated from the fastener bores 270 by a predetermined distance. The predetermined distance is dependent upon the material, design, and thickness of the ring 260 and is a distance that permits elastic deformation of the ring 270 at the post 276 (relative to the fastener bore 270) by a vertical distance (parallel to the thickness 266 of the ring 270) equal to at least the axial length of the post 276 extending downward from the ring 270. When the ring 260 is un-deflected, the post 276 extends axially parallel to a central axis 278 of the ring 260. When the ring 260 is deflected, the post 276 extends axially from the ring 260, but is no longer parallel to a central axis 278 of the un-deformed ring 260.

The posts 276 are offset from one another by similar (e.g., 180 degree) angles such that the posts 276 can be aligned with the snap ring retainer bores 220 in the first axial end 192 of the lock ring 158. The posts 276 are configured to extend into the snap ring retainer bores 220 when the threads 238 of the lock cover 160 are engaged with the threads 202 of the lock ring 158. The posts 276 thereby engage the snap ring retainer bores 220 to rotatably lock the lock cover 160 relative to the lock ring 158 in a rotated position that prevents axial removal of the lock cover 160 from the lock ring 158.

The snap ring retainer 162 further includes a plurality of handles 280 that extend upward (opposite the direction of the posts 276 extending from the ring 260) from the ring 260 that provide handholds for a user to hold the snap retainer 162 (alone or fastened to the lock cover 160), to rotate the snap retainer 162 and lock cover 160, and to elastically deflect portions of the snap ring retainer 162, as described in greater detail below. As shown, the handles 280 are located nearer the outer diameter 264 of the ring 260 than to the inner bore diameter 262 of the ring 260 and are located nearer to the posts 276 than to the fastener bores 270. As shown, the handles 280 extend above the posts 276. In other embodiments, the handles 280 may be radially centered along the ring 260 or may be otherwise positioned radially nearer the inner bore diameter 262.

As shown in FIG. 9, the snap ring retainer is formed of two identical snap ring components 284, each component 284 fastened to the lock cover 160 via fasteners 272 extending through fastener bores 270 at a first distal end 286 of the component 284, and each component 284 including a post 276 located at a second distal end 288 of the component 284. With each snap ring component 284 being fastened to the lock cover 160 at only one distal end 286, the other distal end 288 can be flexed and deflected relative to the lock cover 160, for example, by the predetermined distance described above. In other embodiments, the number of posts 276 may be increased to a plurality of posts 276 per snap ring component 284. Further, the snap ring retainer 162 may be formed of only a single snap ring component 284 or may include more than two snap ring components 284.

In operation, as shown in FIGS. 3, 4, and 10, to assemble and secure the valve 138 within the bore 136 of the fluid end 114, the lock ring 158 is fastened to the housing 124 of the fluid end 114, surrounding the bore 136 into which the valve 138 and valve cover 152B will be inserted. Fasteners 214 are passed through the fastener bores 210 of the lock ring 158 to thread into the fastener bores (not shown) of the fluid end housing 124. Nuts 216 are threaded onto the fasteners 214 and are tightened against the first axial end 192 of the lock ring 158, thereby securing the lock ring 158 to the housing 124 of the fluid end 114. The valve 138 is positioned through the lock ring 158 and within the outlet bore 134 of the fluid end 114, and the bore 136 is sealed by the valve cover 152B. In some embodiments, the valve 138 and valve cover 152B can be installed within the bore 136 prior to installation of the lock ring 158, though, as shown, the valve cover 152B and valve 138 are removable and insertable through the lock ring 158 for replacement and initial assembly without removing the lock ring 158 from the housing 124 of the fluid end 114. The circumferential seal 174 on the cylindrical periphery 176 of the valve cover 152B is energized by its placement within the bore 136 and does not need to be preloaded during installation.

The snap ring retainer 162 is fastened to the lock cover 160 via the fasteners 272. The lock cover 160 is positioned above the lock cover bore 196 of the lock ring 158 and is rotatably aligned such that the gaps 204 between the broken thread segments 206 of the lock ring 158 are axially aligned with the broken thread segments 242 of the lock cover 160 and the broken thread segments 206 of the lock ring 158 are axially aligned with the gaps 240 between the broken thread segments 242 of the lock cover 160. The lock cover 160 is lowered axially (e.g., a purely axial movement) into the lock cover bore 196 of the lock ring 158 until the posts 276 of the snap ring retainer 162 abut the first axial end 192 of the lock ring 158. An operator then applies an axial downward force onto the assembly including the lock cover 160 and snap ring retainer 162, thereby elastically flexing the second distal end 288 of the snap ring retainer 162 relative to the first distal end 286 that is fastened to the lock cover 160. The axial force is applied until the threads 238 of the lock cover are axially displaced into alignment with the appropriate threads 202 of the lock ring 158, thereby deflecting the second distal end 288 of the snap ring 162 by the predetermined distance. When the threads 238 are axially positioned to be aligned as desired, the operator rotates the lock cover 160 (and the attached snap ring retainer 162) relative to the lock ring 158, thereby engaging the threads 202, 238 with one another. As the lock cover 160 rotates, the elastically deflected ring 260 likewise rotates until the posts 276 extending downward from the ring 260 fall into the snap ring retainer bores 220 of the lock ring 158. When the posts 276 fall (by the removal of the stress of the axial deflection) into the snap ring retainer bores 220, the snap ring retainer 162 and the lock cover 160 cannot be rotated relative to the lock ring 158. Therefore, the post 276 of the snap ring retainer 162 is a rotational lock that prohibits rotation of the lock cover 160 relative to the lock ring 158 when the post 276 extends into the bore 220 of the lock ring 158. When secure, the abutment surface 246 of the lock cover 160 is positioned in proximity to and/or in contact with the upper surface 182 of the valve cover 152B, thereby preventing axial translation of the valve cover 152B away from the fluid end housing 124, even in response to increased pressure within the fluid end 114.

In operation, to remove the valve cover 152B or the valve 138, the operator lifts upward on the handles 280, thereby elastically deflecting the second distal end 288 of the ring 260 relative to the first distal end 286 that is fastened to the lock cover 160. The interaction between the threads 238, 202 of the lock cover 160 and lock ring 158 counteract the axial pulling force on the handles 280, but the elastic flexibility of the ring 260 permits a pulling force to remove the posts 276 from the snap ring retainer bores 220. With the posts 276 removed from the bores 220, the operator can rotate the snap ring retainer 162 and the lock ring 160 until the threads 202, 238 are disengaged from one another and the threads 202, 238 of the lock ring 158 and lock cover 160 are aligned with the gaps 240, 204 in the lock cover 160 and lock ring 158, respectively. The lock cover 160 is then axially removed from the lock ring 158 and the valve cover 152B and valve 138 are accessible for removal and replacement.

Various features and advantages of the invention are set forth in the following claims.

What is claimed is:

1. A method of assembling a fluid end, the method comprising:

inserting a valve through a bore of a housing of the fluid end and into an interior volume of the fluid end;

inserting a valve cover into the bore such that the valve cover seals the bore;

coupling a lock cover to the housing, the lock cover positioned over the bore to prevent removal of the valve cover from the bore, wherein, when the lock cover is coupled to the housing, the lock cover does not apply a preload against the valve cover; and coupling a snap ring retainer to the lock cover, wherein coupling the lock cover to the housing includes elastically deflecting the snap ring retainer.

2. The method of claim 1, further comprising controlling a flow of fluid within the housing via the valve after coupling the lock cover to the housing.

3. The method of claim 1, wherein the valve includes a spring and a valve member, wherein the spring is configured to bias the valve member in a closing direction, wherein inserting the valve cover into the bore includes abutting the valve cover against the spring.

4. The method of claim 1, wherein the valve cover includes a circumferential seal, wherein inserting the valve cover into the bore includes engaging the circumferential seal against the bore of the housing.

5. The method of claim 1, wherein coupling the lock cover to the housing includes threading the lock cover to a lock ring, wherein the lock ring is coupled to the housing of the fluid end.

6. The method of claim 5, wherein the lock cover and the housing include broken zero-pitch threads, wherein threading the lock cover to the lock ring includes axially inserting the lock cover within the lock ring and then rotating the lock cover relative to the lock ring.

7. The method of claim 1, wherein coupling the lock cover to the housing further comprises threading the lock cover to a lock ring, and further comprises engaging the snap ring retainer with the lock ring.

8. A method of assembling a fluid end of a pump assembly, the method comprising:

securing a lock ring to a housing of the fluid end, the lock ring defining an axial bore centered about a central axis;

axially inserting a lock cover into the axial bore;

elastically deflecting a snap ring retainer against the lock ring, the snap ring retainer coupled to the lock cover; and aligning a post of the elastically deflected snap ring retainer with a post bore of the lock ring such that the post extends into the post bore.

9. The method of claim 8, wherein the axial bore of the lock ring includes threads, and wherein axially inserting a lock cover into the axial bore includes engaging one or more threads of the lock ring with one or more threads of the lock cover.

10. The method of claim 9, wherein the threads of the lock ring and the threads of the lock cover are broken zero-pitch threads such that engaging the one or more threads of the lock ring with the one or more threads of the lock cover include axially translating the lock cover relative to the lock ring and then rotating the one or more threads of the lock cover into engagement with the one or more threads of the lock ring.

11. The method of claim 8, wherein the snap ring retainer includes an elastically deformable body, wherein the post extends from the elastically deformable body along a post axis, wherein the post axis is parallel to the central axis when the post extends into the post bore, and wherein the post axis is nonparallel to the central axis when the snap ring retainer is elastically deflected against the lock ring.

12. The method of claim 8, further comprising, prior to inserting the lock cover into the axial bore:

inserting a valve through a bore of the housing of the fluid end and into an interior volume of the fluid end, the bore of the housing being axially aligned with the axial bore of the lock ring when the lock ring is secured to the housing; and inserting a valve cover into the bore such that the valve cover seals the bore.

13. The method of claim 12, further comprising:

controlling a flow of fluid within the housing via the valve after inserting the lock cover into the axial bore.

14. The method of claim 12, wherein the valve includes a spring and a valve member, wherein the spring is configured to bias the valve member in a closing direction, and wherein inserting the valve cover into the bore of the housing includes abutting the valve cover against the spring.

15. A fluid end assembly of a hydraulic fluid pump comprising:

a housing having a bore;

a valve cover positioned within the bore and configured to seal the bore;

a lock ring coupled to the housing, the lock ring defining a threaded bore; and a lock cover coupled to the housing and configured to retain the valve cover within the bore during operation of the fluid end assembly, the lock cover being configured to threadedly engage the threaded bore of the lock ring to couple the lock cover to the housing, wherein, when the lock cover is coupled to the housing, the lock cover does not apply a preload against the valve cover, and wherein the lock cover includes a snap ring retainer configured to elastically deflect against the lock ring.

16. The fluid end assembly of claim 15, wherein the bore is an axial bore defined by a central axis, wherein the central axis extends through the valve cover and the lock cover such that the lock cover is located axially adjacent to the valve cover.

17. The fluid end assembly of claim 15, wherein the lock ring includes a bore, and wherein the snap ring retainer includes a post, and wherein the post of the snap ring retainer is configured to extend into the bore of the lock ring.

18. The fluid end assembly of claim 17, wherein the post of the snap ring retainer is a rotational lock that prohibits rotation of the lock cover relative to the lock ring when the post extends into the bore of the lock ring.

19. The fluid end assembly of claim 15, wherein the snap ring retainer is a substantially planar ring having a first end fastened to the lock cover and a second end that is configured to elastically deflect against the lock ring.

20. The fluid end assembly of claim 15, wherein each of the lock cover and the threaded bore of the lock ring includes broken zero-pitch threads.

* * * * *